US011006211B2

(12) United States Patent
Heil et al.

(10) Patent No.: US 11,006,211 B2
(45) Date of Patent: May 11, 2021

(54) SOUND BROADCASTING SYSTEM

(71) Applicant: L-ACOUSTICS, Marcoussis (FR)

(72) Inventors: Christian Heil, Marcoussis (FR); Christophe Combet, Marcoussis (FR)

(73) Assignee: L-ACOUSTICS, Marcoussis (FR)

( * ) Notice: Subject to any disclaimer, the term of this patent is extended or adjusted under 35 U.S.C. 154(b) by 96 days.

(21) Appl. No.: 16/480,640

(22) PCT Filed: Jan. 10, 2018

(86) PCT No.: PCT/FR2018/050060
§ 371 (c)(1),
(2) Date: Nov. 12, 2019

(87) PCT Pub. No.: WO2018/138425
PCT Pub. Date: Aug. 2, 2018

(65) Prior Publication Data

US 2020/0068296 A1 Feb. 27, 2020

(30) Foreign Application Priority Data

Jan. 24, 2017 (FR) ..... 1750580

(51) Int. Cl.
*H04R 1/40* (2006.01)
*H04R 1/02* (2006.01)
(Continued)

(52) U.S. Cl.
CPC ..... *H04R 1/403* (2013.01); *H04R 1/025* (2013.01); *H04R 1/24* (2013.01); *H04R 3/12* (2013.01)

(58) Field of Classification Search
CPC combination set(s) only.
See application file for complete search history.

(56) References Cited

U.S. PATENT DOCUMENTS 5,163,167 A 11/1992 Heil
2008/0212805 A1 9/2008 Fincham
(Continued)

FOREIGN PATENT DOCUMENTS

EP 1635606 3/2006
FR 2364585 4/1978

OTHER PUBLICATIONS

International Search Report and Written Opinion for PCT/FR2018/050060 dated Apr. 4, 2017.

*Primary Examiner* — Duc Nguyen
*Assistant Examiner* — Assad Mohammed
(74) *Attorney, Agent, or Firm* — Patterson Thuente Pedersen, P.A.

(57) ABSTRACT

The invention relates to a sound broadcasting device comprising a high-frequency section including at least one high-frequency acoustic source (SHF), and a medium-frequency section including at least two medium-frequency sources (SMF), the acoustic sources (SHF, SMF) being vertically superposed, where the medium-frequency section comprises a lower sub-section, arranged below the high-frequency section and comprising at least one medium-frequency acoustic source (SMF), and an upper sub-section, arranged above the high-frequency section and comprising at least one medium-frequency acoustic source (SMF), where the vertical directivity of the high-frequency section has an incline, relative to the horizontal (H), that is substantially equal to the incline (θMF) of the vertical directivity of the medium-frequency section relative to the horizontal (H), so that the overall vertical directivity of the device has a non-zero incline (θDir) relative to the horizontal (H).

18 Claims, 8 Drawing Sheets

(51) Int. Cl.
*H04R 1/24* (2006.01)
*H04R 3/12* (2006.01)

(56) References Cited

U.S. PATENT DOCUMENTS

| | | | | |
|---|---|---|---|---|
| 2009/0214067 | A1* | 8/2009 | Bothe | H04R 1/345<br>381/339 |
| 2011/0096947 | A1 | 4/2011 | Oxford et al. | |
| 2012/0014544 | A1 | 1/2012 | Gladwin et al. | |
| 2017/0251296 | A1* | 8/2017 | Smithers | H04R 1/403 |

* cited by examiner

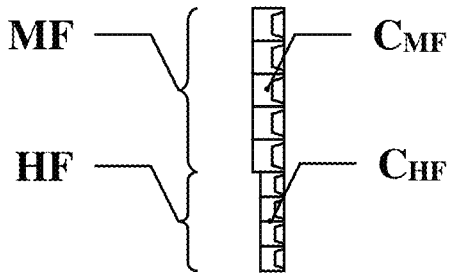
FIG. 2 (Art antérieur)
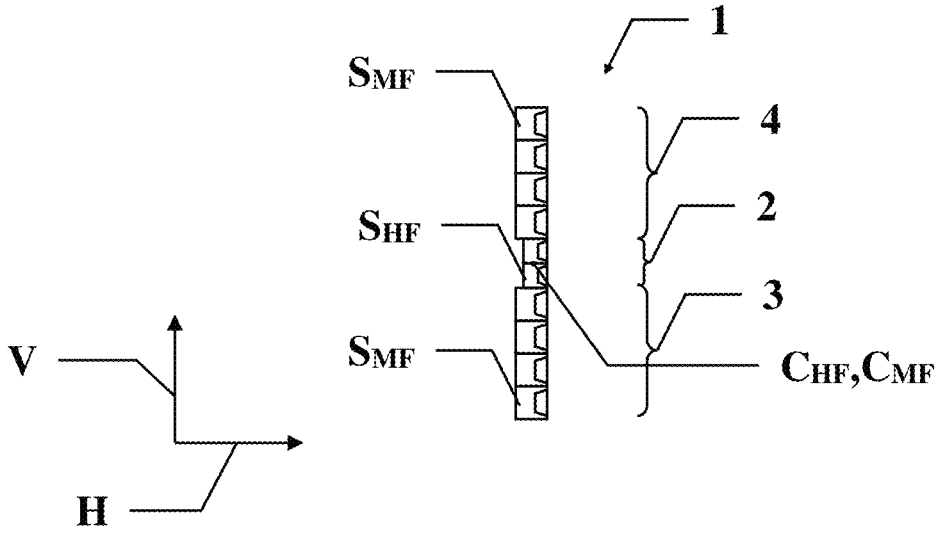
FIG. 3

SOUND BROADCASTING SYSTEM

RELATED APPLICATIONS

This present application is a National Phase entry of PCT Application No. PCT/FR2018/050060 filed Jan. 10, 2018, which claims priority to French Application No. 1750580 filed Jan. 24, 2017, the contents of each being incorporated herein by reference in their entireties.

TECHNICAL FIELD

This invention relates in general to the domain of professional or home sonorization. It is aimed particularly at a "column" sound diffusion system suitable for producing a high Sound Pressure Level (SPL) with a long range to be able to cover an extended audience, while maintaining high coherence/intelligibility.

BACKGROUND ART

It is known that that sound can be produced by propagating a sound signal from an acoustic source such as a loudspeaker, possibly fitted with a sound box, or a loudspeaker enclosure containing several loudspeakers and/or sound boxes.

It is also known that the range can be increased and a large audience can be covered by using multiple acoustic sources within a sound diffusion device or system. The contributions of each acoustic source would be added correctly if all acoustic sources are located at a single point. In practice, this is impossible, because an acoustic source has a non-negligible volume.

Thus a stack of acoustic sources can give a higher sound pressure level (SPL) than the SPL produced by a single acoustic source. The vertical directivity of a vertical stack of acoustic sources has a narrowed and significantly elongated lobe. The vertical directivity is also higher than the vertical directivity of a single acoustic source, thus increasing the range and the audience volume covered. However, acoustic sources are not so easily added and the inevitable distances between acoustic sources produce interference that deteriorates coherence/intelligibility.

It is also known to be advantageous if the vertical directivity of a sound diffusion device has a slightly negative angle of inclination from the horizontal. For a sound diffusion device classically installed at a low height, this makes it possible firstly to cover a larger audience and secondly to avoid diffusion towards the ceiling which would constitute a loss of energy since there is no audience at the ceiling, and can cause unwanted reflections that can degrade intelligibility. A negative inclination of the vertical directivity is generally obtained by inclining the acoustic source or source or the sound diffusion device.

A narrow, elongated and advantageously inclined vertical directivity is required to increase the range. On the other hand, a large horizontal directivity is required, for example between 60 and 180°. To achieve this, it is advantageous to superpose acoustic sources in a vertical stack.

Another constraint for a sound diffusion system is its visual integration. To facilitate this visual integration, it is advantageous to have a system with the lowest possible visual footprint. This constraint combined with the previous constraint, make a "column" arrangement of acoustic sources advantageous.

SUMMARY

A sound diffusion system provides a compromise between apparently contradictory characteristics to increase the sound pressure level, SPL, and the range, while maintaining a high coherence/intelligibility level.

This purpose is achieved by means of a sound diffusion system comprising a high-frequency section including at least one high-frequency acoustic source and a medium-frequency section comprising at least two medium-frequency acoustic sources, the acoustic sources being superposed vertically, in which the medium-frequency section comprises a lower subsection located below the high-frequency section and comprising at least one medium-frequency acoustic source and an upper subsection located above the high-frequency section and comprising at least one medium-frequency acoustic source, and in which the vertical directivity of the high-frequency section has an inclination from the horizontal approximately equal to the inclination of the vertical directivity of the medium-frequency section from the horizontal, such that the global vertical directivity of the device has a non-zero inclination from the horizontal.

According to another characteristic, the inclinations from the horizontal are negative.

According to another characteristic, the high-frequency section has a dissymmetric vertical wavefront.

According to another characteristic, the wavefront has a variable curvature, preferably increasing towards the bottom, and even more preferably continuously variable so as to form a "J".

According to another characteristic, the wavefront is conformed using a vertical waveguide integrating at least one high-frequency acoustic source, preferably all high-frequency acoustic sources.

According to another characteristic, the acoustic center of the lower subsection is set back from the acoustic center of the upper subsection by a distance such that an axis connecting the acoustic center of the lower subsection to the acoustic center of the upper subsection, has a misalignment angle from the vertical significantly equal to the inclination.

According to another characteristic, the medium-frequency acoustic sources of the lower subsection are aligned with each other along a first vertical axis and/or the medium-frequency acoustic sources of the upper subsection are aligned with each other along a second vertical axis.

According to another characteristic, the high-frequency section comprises a first number of high-frequency acoustic sources, preferably identical, the first number preferably being equal to 3.

According to another characteristic, at least one high-frequency acoustic source is a compression motor.

According to another characteristic, the lower subsection comprises a second number of medium-frequency acoustic sources and the upper subsection comprises a third number of medium-frequency acoustic sources, the medium-frequency acoustic sources preferably being identical and the absolute value of the difference between the second number and the third number is less or equal to 2 and the second number is preferably higher than the third number, also preferably the second number is equal to 4 and/or the third number is equal to 2, or the difference is zero.

According to another characteristic, the vertical wavefront is, at least partially, electronically conformed by processing of the sound signals sent to each of the high-frequency acoustic sources respectively.

According to another characteristic, at least part (Rb) of the setback is electronically simulated by delaying the sound signals sent to each of the medium-frequency acoustic sources of the lower subsection and/or the upper subsection respectively, by a delay equal to the time taken by sound to travel along the setback part.

According to another characteristic, the device is integrated into a single "column" type loudspeaker enclosure.

Embodiments of the invention also relate to a sound diffusion system comprising a first sound diffusion device according to one of the preceding embodiments, a second sound diffusion device comprising a low frequency section and/or a very low frequency section.

According to another characteristic, the system also comprises a mechanical interface between the first device and the second device capable of allowing one of the devices, preferably the second device, to support the other device, with or without assembly, and/or an electric interface between the first device and the second device that can allow one of the devices, preferably the second device, to transmit sound signals and/or an electrical power supply to the other device.

BRIEF DESCRIPTION OF THE FIGURES

Other innovative characteristics and advantages of embodiments of the invention will become clear after reading the following description given purely for information purposes and in no way limitative, with reference to the appended figures among which:

FIG. 2 presents a side view of a device according to prior art.

FIG. 3 presents a side view of a device according to embodiments of the invention.

For better clarity, identical or similar elements are represented with identical references on all figures.

DETAILED DESCRIPTION OF ONE EMBODIMENT

An acoustic source S, or a sound diffusion system 1 comprising several acoustic sources S, can be characterized by a directivity diagram containing a Sound Pressure Level (SPL) as a function of the position in space. This diagram typically contains nested 3d lobes, the SPL is significantly constant within a lobe and decreases with increasing distance from the source S or the device 1. A section or projection in a horizontal or vertical plane shows horizontal or vertical directivity respectively.

Figure 1A:
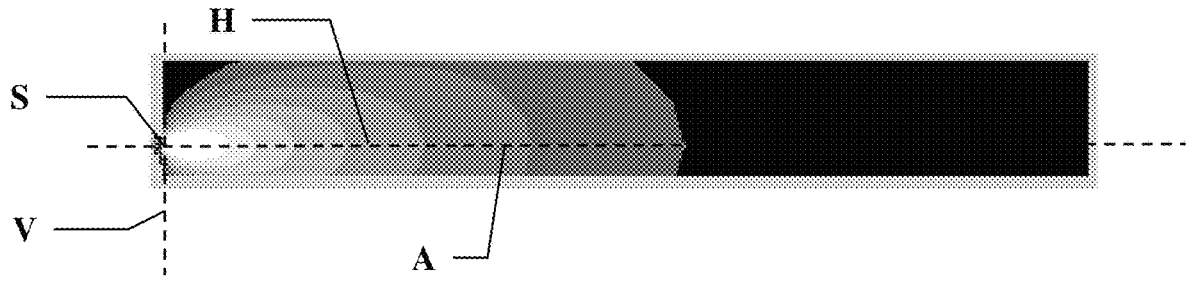
FIG. 1*a* presents the directivity of an acoustic source, in the case of the horn type point source.

FIG. 1*a* illustrates the vertical directivity of a single acoustic source S, for example of the horn type point source. A point source type acoustic source radiates isotropically and has spherical directivity. A significantly conical shaped horn can restrict this directivity to an advantageously more restricted angular sector. An example of a horn point source acoustic source S is the applicant's product X12. The directivity of such an acoustic source S has an acoustic axis A connecting the source S to the maximum SPL, approximately in line with the horizontal H. Thus, if an angle $\theta_{Dir}$ is defined as being the angle between the horizontal H and the acoustic axis A representing the directivity of the source S, we can write the following, for FIG. 1*a*, $\theta_{Dir}=0$.

Figure 1B:
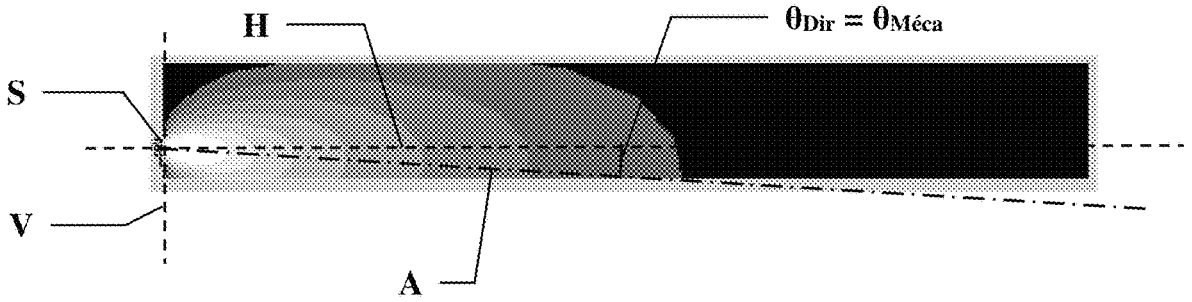
FIG. 1*b* presents the directivity, inclined downwards by an angle $\theta_{Dir}$, obtained by inclining the source in FIG. 1*a* downwards by an angle $\theta_{Meca}=\theta_{Dir}$.

The acoustic source S can be inclined downwards by an angle of inclination $\theta_{Meca}$. The effect of this is to identically incline the directivity and the acoustic axis A by the same angle of inclination $\theta_{Meca}$, as illustrated on FIG. 1*b*.

By convention, the source is shown at the left of all directivity diagrams, and diffuses towards the right. The audience is spread over the entire width of the diagram, mainly concentrated horizontally at the bottom of the diagram. For guidance, the area of the diagram represents a height of 5 m and a width/depth of 40 m. Each change in the grey shade corresponds to a reduction of 3 dB with increasing distance from the acoustic source S.

In order to diffuse a sound signal, an acoustic source S or a sound diffusion system 1 is generally placed facing an audience, the acoustic axis A being significantly horizontal so that the lobe covers the audience. Comparing FIG. 1*b* with FIG. 1*a* shows that a slightly negative inclination $\theta_{Dir}$ of the acoustic axis A from the horizontal H is advantageous in terms of the volume of audience covered and in terms of uniformity of the SPL. This is particularly true when the range is high. Furthermore, such a negative inclination $\theta_{Dir}$ prevents unwanted and/or prejudicial diffusion towards the ceiling.

In a sound diffusion system 1, it is classical to divide the sound spectrum into frequency bands, and to dedicate one section including one or several acoustic sources to each frequency band. This makes it possible to make each section with one or several acoustic sources adapted to this frequency band.

One arbitrary but frequently used breakdown in the business consists of breaking down the sound spectrum as follows, at least partially covering the spectrum audible to humans: 20 Hz-20 kHz, in three or four bands. A high-frequency HF band covers the highest frequencies, typically over a 1 kHz-20 kHz interval. A medium-frequency MF band covers intermediate frequencies, typically over a 200 Hz-1 kHz interval. A low frequency LF band covers the lowest frequencies, typically over a 50 Hz-200 Hz interval. Finally, an optional very low frequency VLF band covers the lowest frequencies, typically frequencies less than 50 Hz.

The device 1 according to a first embodiment of the invention proposed to cover the two top bands; the high-frequency band and the medium-frequency band. This sound diffusion device 1 comprises a high-frequency section 2 and a medium-frequency section 3, 4. The high-frequency section 2 comprises one or several high-frequency acoustic sources $S_{HF}$. The medium-frequency section 3, 4 comprises several medium-frequency acoustic sources $S_{MF}$. Being a "column" device, all high-frequency and low frequency acoustic sources $S_{HF}$, $S_{MF}$ are superposed vertically, without necessarily being aligned.

As illustrated in FIG. 2, classically in the above, and as confirmed by an analysis of products on the market, existing devices combine firstly all high-frequency acoustic sources within a single high-frequency HF assembly, and secondly all medium-frequency acoustic sources within a single medium-frequency MF assembly, and then puts the two HF, MF assemblies together. This is prejudicial in that, due to the non-negligible size of acoustic sources, the high-frequency acoustic center CHF is at a distance from the medium-frequency acoustic center CMF. Such an offset causes a degradation of the coherence/intelligibility of the sound.

According to one characteristic illustrated particularly in FIG. 3, this problem is solved by making a device 1 that separates the medium-frequency section into two subsections 3, 4 and arranging these two subsections 3, 4 on opposite sides of the high-frequency section 2. Thus, either one of the two subsections is placed below the high-frequency section 2 and is called the lower subsection 3, while the other subsection is placed above the high-frequency section 2 and is called the upper subsection 3.

As illustrated on FIG. 3, the result of such an arrangement is that the medium-frequency acoustic center $C_{MF}$ resulting from the two subsections 3, 4 is located between the two subsections 3, 4, and may be close to or even advantageously coincident with the high-frequency acoustic center $C_{HF}$. This proximity of the high-frequency and medium-frequency acoustic centers $C_{HF}$ and $C_{MF}$ improves the coherence/intelligibility of the sound.

In order to diffuse sound with good coherence/intelligibility, it is convenient that the medium-frequency and high-frequency directivities are substantially superposed. To achieve this, it is desirable that the inclination $\theta_{HF}$ of the maximum high-frequency SPL of the vertical directivity of the high-frequency section 2 from the horizontal H, and the inclination Ow of the maximum medium-frequency SPL of the vertical directivity of the medium-frequency section 3, 4 from the horizontal H, are substantially equal. "Substantially equal" means that the absolute value of the difference between the inclination $\theta_{HF}$ and the inclination $\theta_{MF}$ is between 0° and 5°, and preferably between 0° and 2°.

A device 1 comprising a high-frequency section 2 surrounded by two medium-frequency subsections 3, 4, the two subsections 3, 4 and the high-frequency section 2 being significantly in line along a vertical axis, has a high-frequency vertical directivity derived from the high-frequency center $C_{HF}$ and with a substantially zero high-frequency inclination $\theta_{HF}$ from the horizontal H and a medium-frequency directivity derived from the medium-frequency center $C_{MF}$ and having a significantly zero medium-frequency inclination $\theta_{HF}$ from the horizontal H. The two inclinations $\theta_{HF}$, $\theta_{LMF}$ are thus significantly equal. The result is that the high-frequency and the medium-frequency directivities are significantly superposed.

As mentioned above, it is useful if the vertical directivity is at a negative inclination $\theta_{Dir}$, so as to cover an audience, classically located lower down. According to a first embodiment, this inclination $\theta_{Dir}$, that must be the same for the medium-frequency inclination $\theta_{MF}$ and for the high-frequency inclination $\theta_{HF}$ can be obtained by inclining the device 1 from the vertical v, by an angle $\theta_{Meca}$. Advantageously, the inclination of the vertical directivities of the medium-frequency or high-frequency sources has an absolute value of between 1° and 30°.

The juxtaposition of acoustic sources S, in principle produces interference due to the inevitable separation between acoustic sources S. A rule used in standard practice indicates that the distance between two acoustic sources S can be neglected with regard to interference if this distance remains less than a magnitude that is an increasing function of the wavelength. Despite the fact that the dimension of acoustic sources reduces with reducing wavelength, this rule becomes increasingly difficult to respect as the wavelength reduces.

Considering the dimensions of envisaged medium-frequency acoustic sources $S_{MF}$, this rule can be respected for the medium-frequency section 3, 4, even when a high-frequency section 2 is intercalated, thus increasing the distance between medium-frequency acoustic sources $S_{MF}$. For information, it will be noted that in one preferred embodiment, the height of the high-frequency section is of the order of a few tens of cm.

Figure 4:
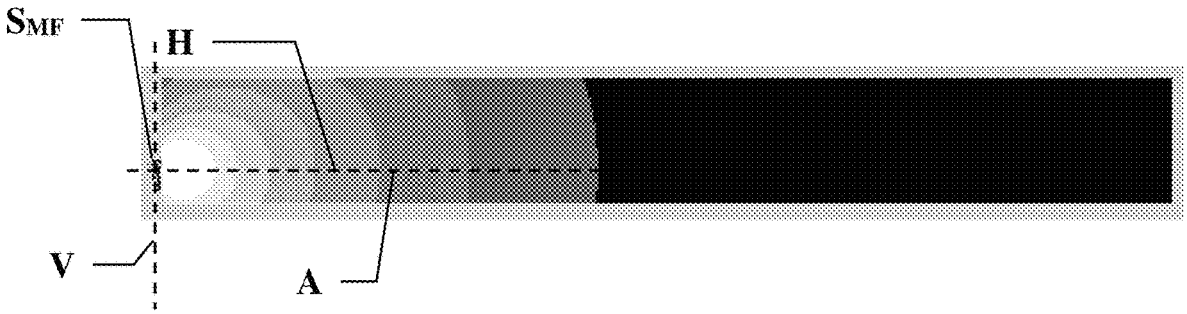
FIG. 4 presents the vertical directivity of a medium-frequency acoustic source, in the case of the horn type point source.
Figure 5:
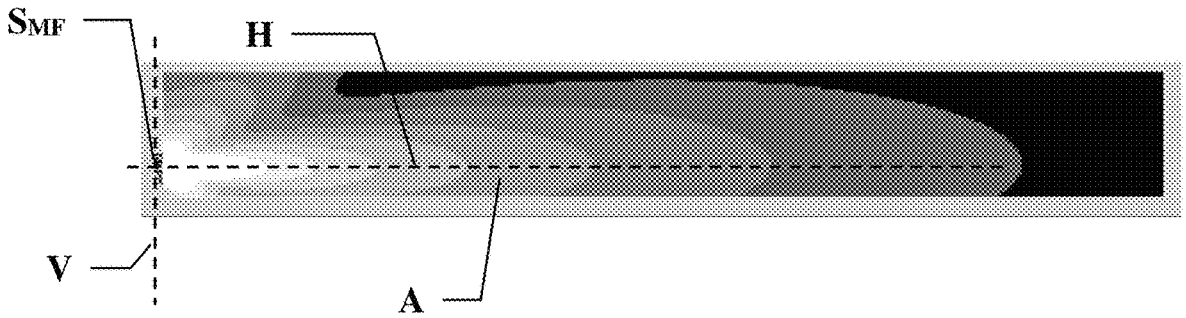
FIG. 5 presents the vertical directivity of a superposition of medium-frequency acoustic sources similar to the source in FIG. 4.

It can be seen in FIGS. 4 and 5 that this rule is respected. FIG. 4 shows the vertical directivity of a single medium-frequency source $S_{MF}$. Comparatively, FIG. 5 shows the resulting vertical directivity for a stack of medium-frequency acoustic sources $S_{MF}$. Stacking several medium-frequency acoustic sources $S_{MF}$ advantageously increases the resulting range. However no disturbance occurs, indicating that there is practically no interference.

Figure 6:
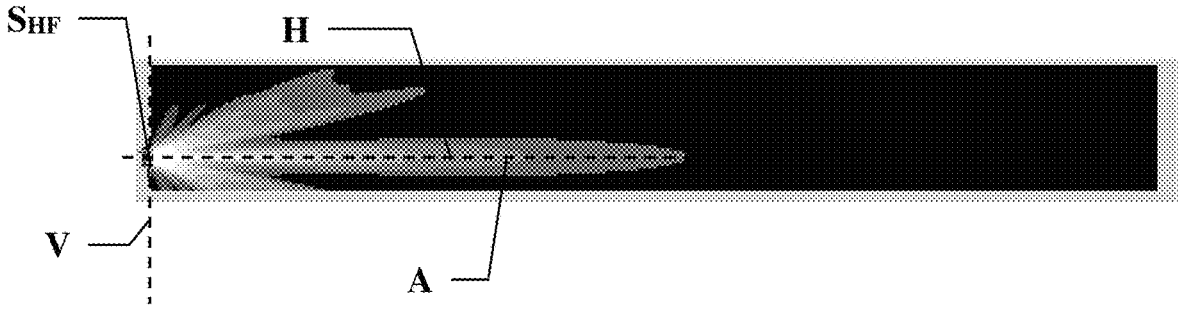
FIG. 6 presents the vertical directivity of a superposition of high-frequency acoustic sources.

On the other hand, considering the dimensions of available high-frequency acoustic sources $S_{HF}$, this rule can be difficult to respect for the high-frequency section 2. FIG. 6 shows the resulting vertical directivity for a stack of high-frequency acoustic sources $S_{HF}$, in this case three sources. Stacking several high-frequency acoustic sources $S_{HF}$ advantageously makes the resulting range larger than for a single acoustic source. However, the disturbance of the diagram indicates an interference problem.

Failing acting on the cause, bringing the high-frequency acoustic sources $S_{HF}$ closer can solve the interference problem and can be corrected by using a wave guide 5. A waveguide 5 is a device containing one or several acoustic sources S and designed to perform two functions. A first function is to eliminate interference by phasing said integrated acoustic sources, that then function like a single more powerful source. A second function is to conform the output sound wave front according to a given profile. The principle and the design of a waveguide invented by the applicant is described particularly in U.S. Pat. No. 5,163,167.

Figure 10A:
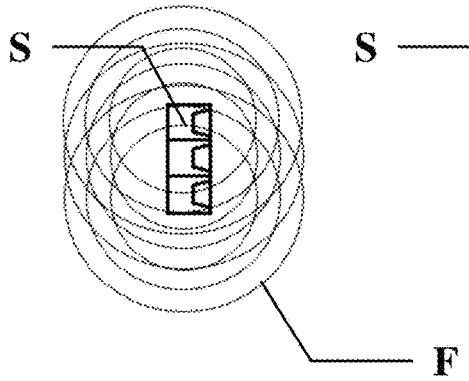
FIGS. 10*a-b* illustrate the function of a waveguide.
Figure 10B:
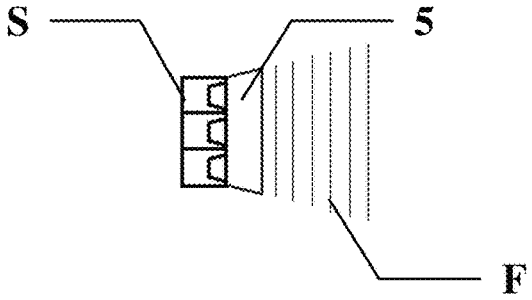

The action of a waveguide 5 is illustrated in FIGS. 10*a-b*. Three acoustic sources S are juxtaposed on FIG. 10*a*. The sources S, assumed to be point sources, each produce a spherical wavefront F. Each front F is centered on its source S. The fronts F are also mutually incoherent and potentially the source of interference. On FIG. 10*b*, the same three sources S are combined using a waveguide 5. The produced wavefront F is unique.

A person skilled in the art will be able to design a waveguide 5 as a function firstly of acoustic sources $S_{HF}$ and secondly of the required wavefront.

Thus, according to another characteristic, a waveguide 5 is advantageously used to eliminate the harmful consequences of interference at the high-frequency section 2.

A waveguide is improperly characterized by the shape of the wavefront that it produces. Thus for example, the waveguide 5 in FIG. 10*b* that conforms the wavefront F produced at the output in a plane is called a plane waveguide.

Figure 7A:
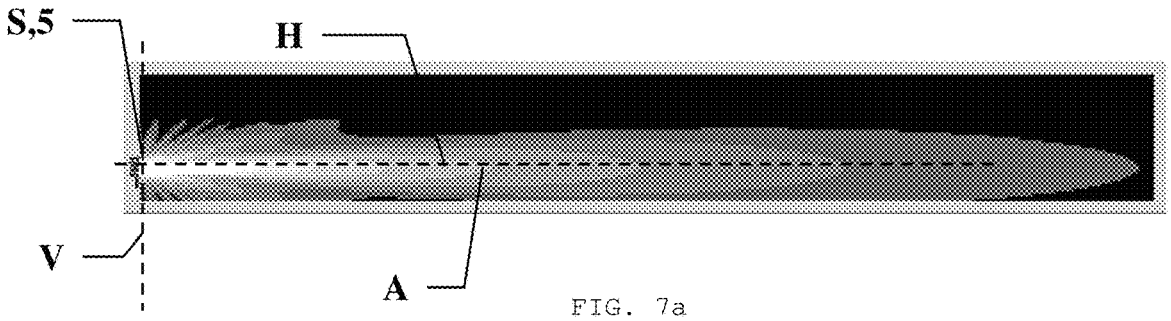
FIG. 7*a* presents the vertical directivity of the same superposition of high-frequency acoustic sources, provided with a plane waveguide.
Figure 7B:
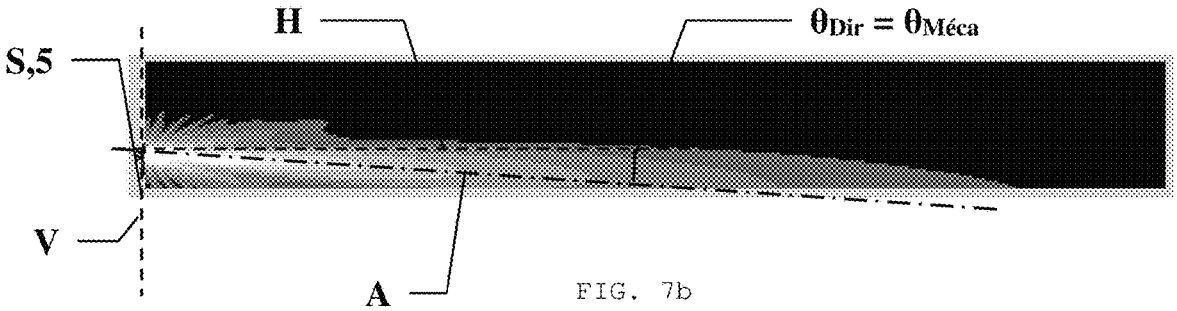
FIG. 7*b* presents the vertical directivity, inclined downwards by an angle $\theta_{Dir}$, obtained by inclining the device in FIG. 7*a* downwards by an angle $\theta_{Meca}=\theta_{Dir}$.

FIG. 7*a* illustrates the vertical directivity resulting from the vertical superposition of several high-frequency sources $S_{HF}$ integrated in a plane waveguide 5. A comparison with FIG. 6 provides a measurement of the improvement made in terms of the homogeneity of the SPL produced and the increased range. Such a device can be inclined by an inclination $\theta_{Meca}$ so as to incline the directivity by the same inclination $\theta_{Dir}=\theta_{Meca}$, as illustrated in FIG. 7*b*. The benefit of the advantageous presence of such a waveguide 5 is obtained by using the waveguide 5 to conform the wavefront output from the high-frequency section 2, and therefore the high-frequency directivity, such that it optimizes the coverage of the audience.

Besides, according to another characteristic, the wavefront is dissymmetric. This dissymmetry that is accentuated downwards, introduces another embodiment to produce a negative high-frequency inclination $\theta_{HF}$.

Figure 11A:
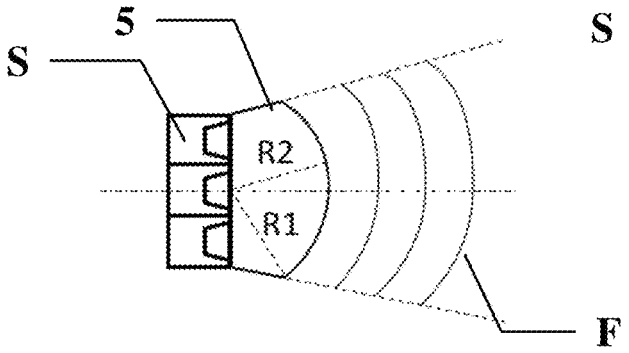
FIGS. 11*a-b* present the different types of waveguide.
Figure 11B:
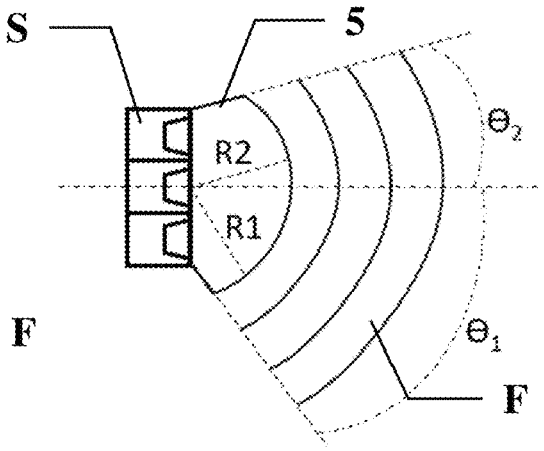

FIG. 11*a* illustrates an example of a waveguide symmetric about the horizontal H. FIG. 11*b* gives a comparative illustration of an example of a dissymmetric waveguide: the absolute value of the upper angle $\theta_2$ is different from the absolute value of the lower angle $\theta_1$, and in this case is less than the lower angle $\theta_1$. This results in an equivalent dissymmetry of the wavefront.

Dissymmetry of the wavefront can be used to make a high-frequency inclination $\theta_{HF}$ of the vertical directivity, also advantageously negative, and thus replace an inclination of the high-frequency section 2 or the device 1. This advantageously makes it possible to keep a vertical layout for the high-frequency section 2 or the device 1, thus improving the visual footprint and facilitating architectural integration.

Alternatively, and particularly if the device 1 must be located higher and if it is required to increase the inclination $\theta_{Dir}$ of the global directivity of the device 1, an inclination obtained by dissymmetry of the wavefront can be combined with an inclination of the device 1, these two inclinations being additive.

The shape of the wavefront can be arbitrary and is advantageously described by a curvature. The curvature can be arbitrary. Thus, a constant curvature, produces a circular external surface.

FIGS. 11*a-b* illustrate the curvature of the waveguide 5 again. In the case of a constant curvature, the radius of curvature R1, R2 is constant and equal at all points. In the case of a variable curvature, the radius of curvature varies and R1 can be different from R2.

According to another characteristic, a variable curvature is advantageous in that it makes it possible to conform the directivity so that it can cover a large audience.

According to another preferred characteristic, the variation of the curvature is such that it increases downwards or, what is equivalent, that the radius of curvature reduces downwards. Thus, according to one preferred embodiment, the curvature is continuously variable. The wavefront then has a "J" shape with a radius of curvature that reduces with increasing downwards distance.

Figure 8:
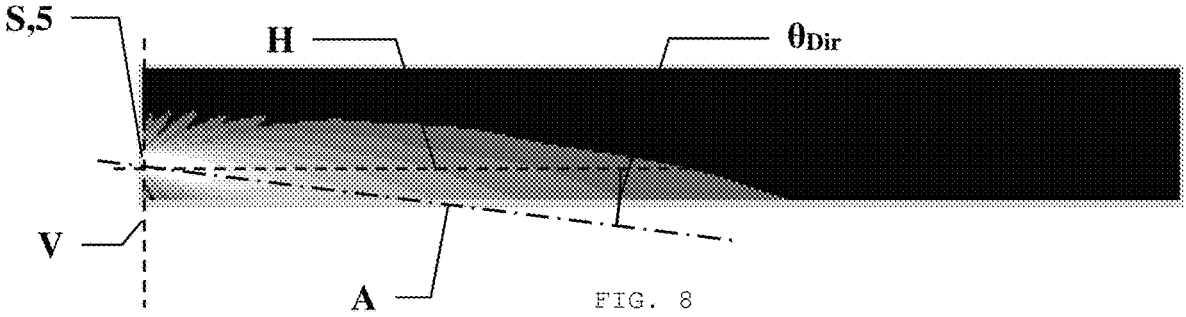
FIG. 8 presents the vertical directivity of the same superposition of high-frequency acoustic sources, provided with a dissymmetric waveguide with constant curvature.
Figure 9:
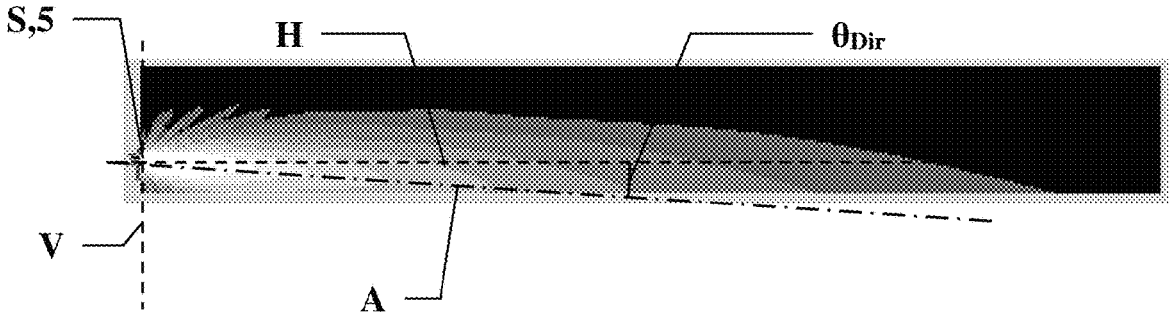
FIG. 9 presents the vertical directivity of the same superposition of high-frequency acoustic sources, provided with a dissymmetric waveguide with variable curvature.

Thus, FIG. 8 shows the vertical directivity obtained for a high-frequency section 2, with a dissymmetric wavefront with constant curvature. This directivity can be compared with that in FIG. 7*b* obtained with a device with a plane wavefront, to measure the improvement obtained, mainly in terms of homogeneity of the SPL achieved in the zone covered. Comparatively, all other things being equal, FIG. 9 shows the directivity obtained for a dissymmetric waveguide with variable curvature, the curvature increasing downwards. There is a significant increase in the range and homogeneity of the SPL.

Figure 12:
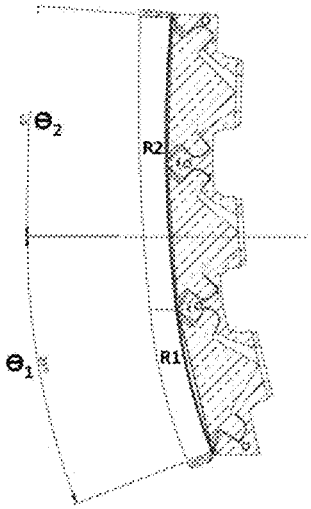
FIG. 12 is a side view illustrating a preferred embodiment of a dissymmetric type waveguide with variable curvature, increasing towards the bottom and continuously variable, in "J" form.

FIG. 12 illustrates one possible embodiment of such a waveguide 5, dissymmetric with variable curvature, the curvature increasing downwards, continuously variable, so as to have a "J" shape.

Conformation of the wavefront, principally by means of its dissymmetry, make a negative high-frequency inclination $\theta_{HF}$ possible. An almost identical medium-frequency inclination $\theta_{HF}$ should be made so that the device 1 is balanced. As before, "almost identical" means that the absolute value of the difference between the inclination $\theta_{HF}$ and the inclination Ow is between 0° and 5°, and preferably between 0° and 2°.

Figure 13:
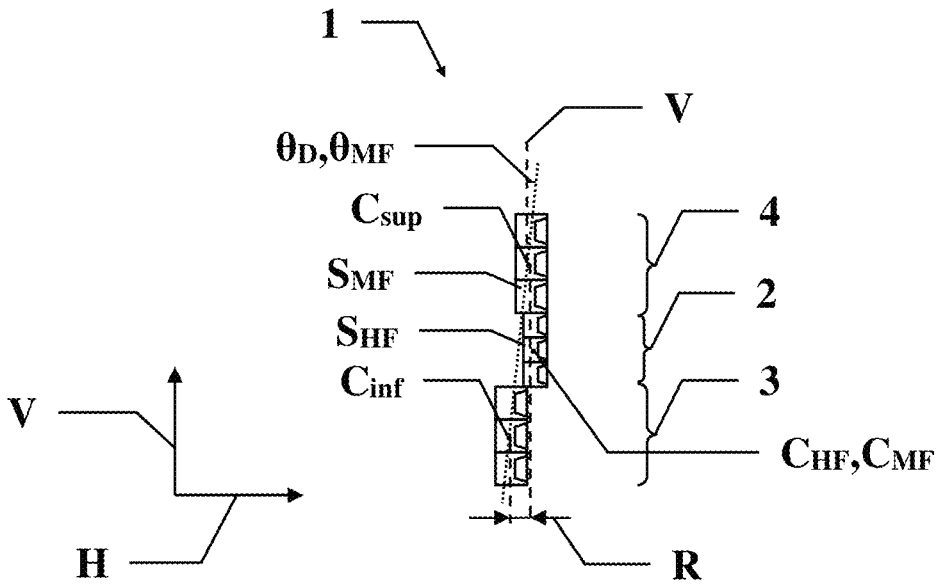
FIG. 13 is a side view showing one embodiment of the device according to the invention.

To achieve this, and as illustrated in FIG. 13, according to another characteristic, the acoustic center $C_{inf}$ of the lower subsection is set back relative to the acoustic center $C_{sup}$ of the upper subsection 4, by a setback R. This setback R produces an inclination $\theta_{MF}$ of the medium-frequency directivity. Also, in order for the medium-frequency inclination $\theta_{MF}$ to be almost identical to the high-frequency inclination $\theta_{HF}$ obtained for the high-frequency section 2, the setback R should be such that an axis connecting the two subsections 3, 4, or more precisely the acoustic center $C_{inf}$ of the lower subsection 3 to the acoustic center $C_{sup}$ of the upper subsection 4, forms a misalignment angle $\theta_D$ from the vertical V approximately equal to the angle of inclination of the high-frequency directivity $\theta_{HF}$. Thus, equality of the angles of inclination $\theta_{MF}$, $\theta_{HF}$, is confirmed. The result is that the high and medium-frequency vertical directivities are substantially superposed.

The layout of the medium-frequency acoustic sources $S_{MF}$ within a subsection 3, 4 is a priori arbitrary. Preferably, an alignment of medium-frequency acoustic sources $S_{MF}$ in a subsection 3, 4 is more efficient in terms of adding powers so as to obtain a high resulting SPL.

Thus, an ideal configuration for the sound produced is the configuration in which the medium-frequency acoustic sources $S_{MF}$ within a subsection 3, 4 are aligned on the previously described axis connecting the acoustic centers $C_{inf}$ and $C_{sup}$ of subsections 3, 4. However, such a configuration increases the dimensions, mainly in depth, and degrades the visual footprint.

Besides, another configuration that does not significantly degrade the sound produced may be preferred. In this other configuration, the medium-frequency acoustic sources $S_{MF}$ of the lower subsection 3 are aligned with each other along a first vertical axis. Alternatively or additionally, the medium-frequency acoustic sources $S_{MF}$ of the upper subsection 4 are aligned with each other along a second vertical axis, that may be identical to the first. These configurations are advantageous in that they provide a low visual footprint and thus facilitate architectural integration.

There is no tight constraint on the position of subsections 3, 4 relative to the high-frequency section 2 along a horizontal axis, in depth. It is preferable to not move them too far apart so as to not excessively separate the acoustic centers $C_{HF}$ and $C_{MF}$, and also subsections 3, 4 are preferably aligned with the high-frequency section 2. According to one possible embodiment illustrated on FIG. 13, the upper subsection 4 is in line with the top of the high-frequency section 2, so as to limit the size of the device 1, in depth. This is also illustrated by the embodiment in FIG. 14.

The high-frequency section 2 comprises a first number n of high-frequency acoustic sources $S_{HF}$. This number is related mainly to the required SPL at high-frequency, this level increasing with the number of high-frequency acoustic sources $S_{HF}$. A single high-frequency acoustic source $S_{HF}$ is possible. It can be noted that a waveguide functions with a single acoustic source. The increase in the number of high-frequency acoustic sources $S_{HF}$ could be prejudicial in that it increases the distance between the two subsections 3, 4. However, this prejudice remains low due to the small size typical of high-frequency sources $S_{HF}$. FIG. 3, 13-14 or 18*a*-*b*, illustratively show a high-frequency section 2 comprising two, three or four high-frequency acoustic sources $S_{HF}$ and the height may then be of the order of 20 to 40 cm. Advantageously, but without any obligation, these high-frequency acoustic sources $S_{HF}$ are identical. According to one preferred embodiment, the first number n of high-frequency acoustic sources $S_{HF}$ of the high-frequency section 2 is equal to 3. Preferably, this first integer number n is within the interval [2; 5].

The search for a high SPL, including for the high-frequency section 2, and in a small integration volume, leads to the preferred use of at least one compression motor to make one or several high-frequency sources $S_{HF}$, due to the advantageously high power density provided by such a component.

The lower subsection 3 comprises a second number m of medium-frequency acoustic sources $S_{MF}$ and the upper subsection 4 comprises a third number p of medium-frequency acoustic sources $S_{MF}$. The total number m+p is related mainly to the required SPL level at medium-frequency, this level increasing with the total number of medium-frequency acoustic sources $S_{MF}$. This SPL level is preferably coherent with the SPL level at high-frequency. A single medium-frequency acoustic source $S_{MF}$ in one or both of the two subsections 3, 4 is possible. The increase in the number of medium-frequency acoustic sources $S_{MF}$ is only prejudicial in that it increases the height and therefore the size of the device 1. According to one preferred embodiment, the medium-frequency section comprises 6 medium-frequency acoustic sources $S_{MF}$: the second number m of medium-frequency acoustic sources $S_{MF}$ of the upper subsection 4 is equal to 2 and the third number p of medium-frequency acoustic sources $S_{MF}$ of the lower subsection 3 is equal to 4. Preferably, the second integer number m is within the interval [1; 5], and the third integer number p is within the interval [2; 6].

According to the previous embodiment, comprising 6 medium-frequency acoustic sources $S_{MF}$, combined with a high-frequency section 2 comprising 3 high-frequency acoustic sources Sur, to achieve an illustrative SPL of the order of 130 dB, the height of a medium-frequency acoustic source $S_{MF}$ is of the order of 13 cm and the height of a high-frequency acoustic source $S_{HF}$ is of the order of 8 cm. The result is that the height of the device 1 is advantageously less than 1.30 m, thus facilitating handling.

With regard to interference, it has been seen that the distance between two juxtaposed adjacent acoustic sources must remain less than a magnitude that is an increasing function of the wavelength. This constraint is much less severe for medium frequencies than for high frequencies. This makes it possible to separate the medium-frequency section into two subsections 3, 4. This also avoids the need to use a waveguide 5 for medium frequencies.

Any arbitrary distribution of medium-frequency acoustic sources $S_{MF}$ between the two subsections 3, 4 is possible. Ideally, for the medium-frequency acoustic center $C_{MF}$ to be as close as possible to the high-frequency acoustic center $C_{HF}$, an equilibrium, namely a second number m equal to the third number p is preferred. FIG. 13 illustratively shows a balanced lower subsection 3 and upper subsection 4 each comprising three medium-frequency acoustic sources Sw.

However, a slight unbalance is acceptable. A difference with an absolute value less than or equal to 2 between the second number m of medium-frequency acoustic sources $S_{MF}$ in the upper subsection 4 and the third number p of medium-frequency acoustic sources $S_{MF}$ in the lower subsection 3 is acceptable. The most "voluminous" subsection can be either the lower subsection 3 or the upper subsection 4, whichever is preferred.

Figure 14:
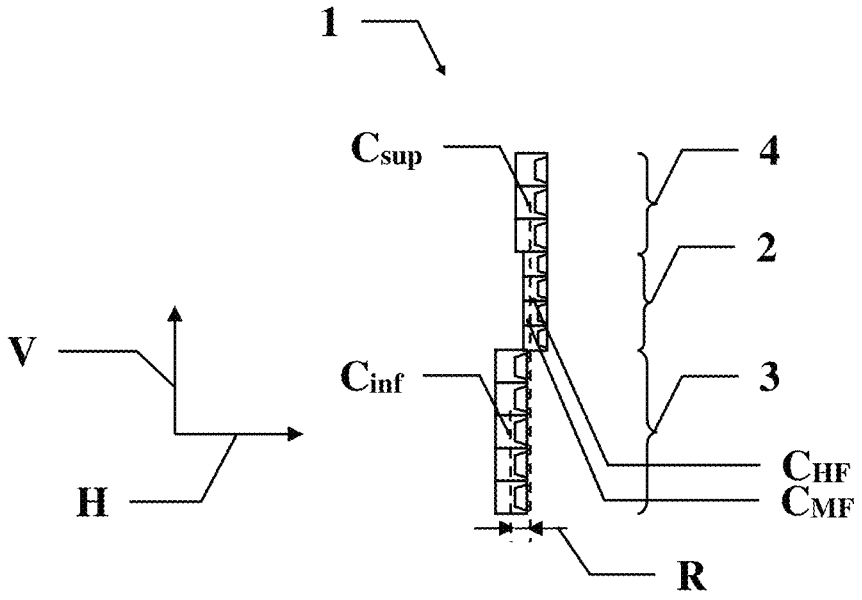
FIG. 14 is a side view of another embodiment of the device according to the invention.

According to one preferred embodiment, more particularly illustrated in FIG. 14, the lower subsection 3 is preferred, for example with one or as illustrated with two, additional acoustic sources. This causes the medium-frequency acoustic center $C_{MF}$ to be slightly separated from the high-frequency acoustic center Cur however the consequences of this can be neglected. However, advantageously, this makes it possible to raise the average diffusion axis, passing approximately through the middle of the acoustic centers $C_{MF}$, $C_{HF}$ of the device 1, so as to adapt it to the listening height of the audience. This is particularly advantageous for a placed device 1.

Advantageously, but without any obligation, the medium-frequency acoustic sources $S_{MF}$ are identical. Identity may lie within a subsection 3, 4, or it can be global.

According to a first embodiment, the wavefront can be conformed mechanically using a waveguide 5. The waveguide 5 is then a frame specifically conformed to form the required wavefront and holding the acoustic sources and imposing a position and a relative orientation on them.

According to another technical characteristic, the wavefront is electronically conformed by processing of sound signals sent to each of the high-frequency acoustic sources $S_{HF}$ respectively. This electronic conformation can be partial or total.

In the case of a fully electronic conformation of the wavefront, electronic conformation entirely replaces the mechanical waveguide 5 and electronically fixes the relative position and orientation of the acoustic sources $S_{HF}$. In this case, the curvature imposed by the waveguide 5 on the acoustic sources $S_{HF}$ no longer serves any purpose. This then makes it possible to have several, and advantageously all high-frequency acoustic sources $S_{HF}$ of the high-frequency section 2 in a chosen layout, for example aligned with each other, and preferably aligned along a vertical axis. This characteristic can optimize the reduction in the visual footprint.

In the case of a partially electronic conformation of the wavefront, a mechanical waveguide 5 is used. Electronic processing then completes shaping of the wavefront produced mechanically by the waveguide 5, to accentuate or reduce the curvature.

It has been seen that the vertical directivity in medium-frequency was inclined downwards by means of a setback R applied to the lower subsection 3 relative to the upper subsection 4. According to a first embodiment, this setback R can be applied geometrically by physically moving the lower subsection 3 backwards. Thus, with medium-frequency acoustic sources Sr with a height of the order of 13 cm, a setback of the order of 40 cm can give an inclination $\theta_{MF}$ of the vertical directivity at medium-frequency of −3°.

According to another embodiment this setback 4 can be made partially or entirely electronically. This requires processing of sound signals sent to each of the medium-frequency acoustic sources $S_{MF}$ of the lower subsection 3 and/or the upper subsection 4.

A setback R is made by retarding sound signals sent to medium-frequency acoustic sources $S_{MF}$ that are to be set back, namely those in the lower subsection 3. The applied delay T then corresponds to the time necessary for sound to travel the distance R. Application of such a relative delay T between the lower subsection 3 and the upper subsection 4 then makes it possible to geometrically align the two subsections 3, 4 or more precisely, their acoustic centers $C_{inf}$ and $C_{sup}$ respectively along a vertical axis. This characteristic is advantageous in terms of the visual footprint of the device 1 and architectural integration.

According to a mixed embodiment, a first part Ra of the setback R is made geometrically by effectively setting back the acoustic sources $S_{MF}$ by a distance Ra, while a second part Rb of the setback R is made electronically by retarding the sound signals by a delay corresponding to the time necessary for sound to travel the distance Rb. The two parts are added together to form the setback: Ra+Rb=R.

Each medium-frequency acoustic source $S_{MF}$ can be electronically controlled individually. However, electronic processing means are expensive. In one particular advantageous embodiment, a single electronic processing comprising a fixed delay is applied to the sound signals of medium-frequency acoustic sources $S_{MF}$ of the lower subsection 3, so as to reduce the number of these processing means. If the delay corresponds to the setback R, the acoustic sources of the lower subsection 3 can be vertically aligned with the upper subsection 4.

The device 1 as described above can be made in different manners. Thus, it can be made by a modular assembly from elements in a kit. According to one preferred embodiment, it is advantageously integrated into a single speaker enclosure.

The device 1, as described above, diffuses high frequencies and medium frequencies. The device 1 is advantageously completed by a second sound diffusion device 7 comprising a low frequency section and/or a very low frequency section 9, so as to constitute a system capable of covering the entire audible sound spectrum.

Such an embodiment separating the low and/or very low frequency is advantageous in that the volume, and therefore the lateral dimension and depth of an acoustic source increases as the frequency drops. Also, a low frequency and very low frequency acoustic source, although it controls the width/depth of a system over its entire height, results in a very wide system with a strong visual impression.

Figure 16:
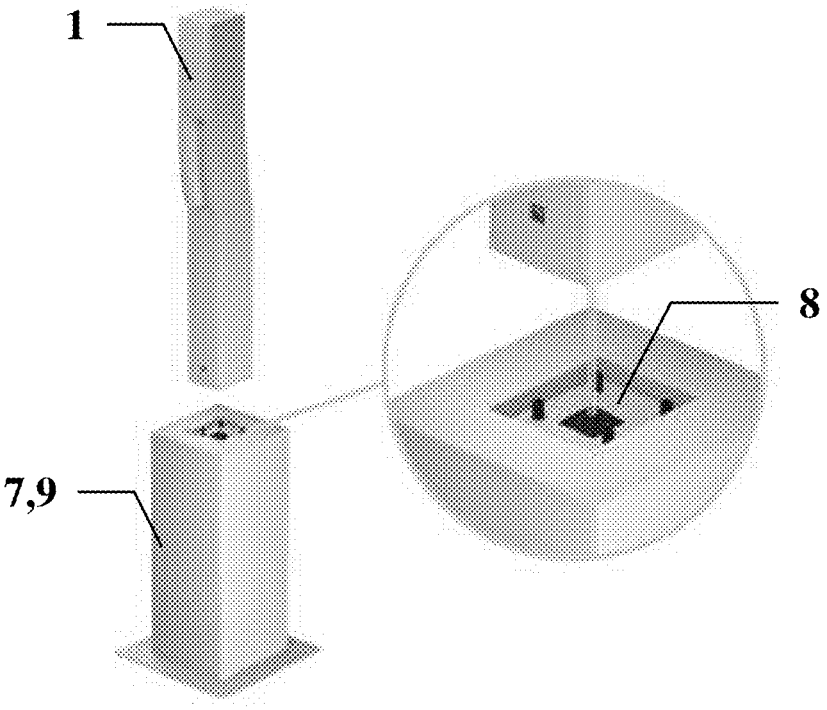
FIG. 16 is a perspective view illustrating a system according to an embodiment of the invention.

Separating firstly the medium and high-frequency and secondly the low and/or very low frequency makes it possible to make a system as illustrated on FIG. 16, with a very much smaller visual impression, at least for device 1.

Figure 15:
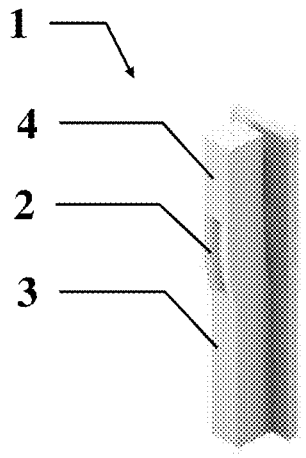
FIG. 15 is a perspective view showing one embodiment of the device according to the invention.

Making the diffusion system in two devices 1, 7 is also advantageous in terms of architectural integration. The second device 7 is typically placed on the floor or on a stage. The first device 1 can advantageously can be suspended independently, as illustrated in FIG. 15.

Alternatively, if it is required to have a single-piece diffusion system, the two devices 1, 7 can be combined. According to one embodiment, illustrated more particularly in FIG. 16, the devices 1, 7 comprise an interface means 8 such as male/female interfaces placed on one or the other or distributed on both of the first device 1 and the second device 7, 9.

Figure 17:
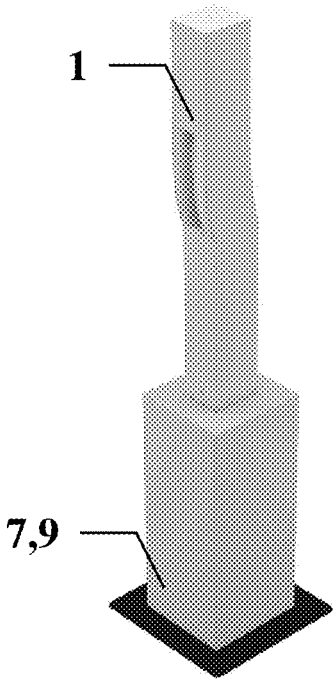
FIG. 17 is a perspective view illustrating the assembled system in FIG. 16.

This interface means 8 advantageously comprises a mechanical interface means that will enable one of the devices 1, 7, to support the other device. Allowing for the relative masses, the second device 7 is preferably the device that supports the first device 1 and therefore that integrates the mechanical interface. This assembly can be made with or without assembly at the interface. The result of the combination of a first device 1 and a second device 7 is illustrated in FIG. 17. According to this embodiment, this mechanical interface means can enable devices 1, 7 to engage one in the other.

The interface device 8 also advantageously comprises an electric interface means that can enable one of the devices 1, 7, to transmit sound signals and/or electrical power supply to the other device, so that it is only necessary to connect the system to the control e center once.

Figure 18A:
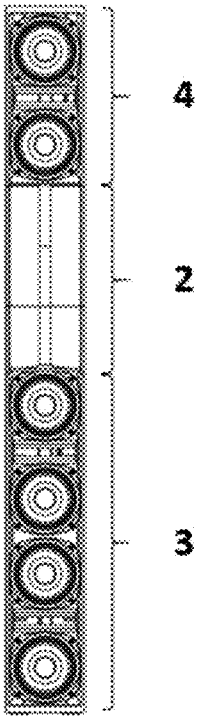
FIGS. 18*a-b* are front and side views respectively illustrating one embodiment of the device.
Figure 18B:
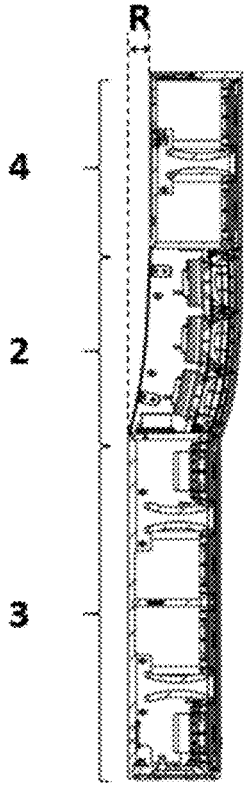

FIGS. 18*a-b* show a front view and a side view respectively of one embodiment of the device 1. In this case, the upper subsection 4 comprises two medium-frequency acoustic sources $S_{MF}$ and the lower subsection 3 comprises four medium-frequency acoustic sources $S_{MF}$. The high-frequency section 2 comprises three high-frequency acoustic sources $S_{HF}$ and a waveguide 5 with a continuously variable curvature with a "J" shape.

The invention is described above as an example. It is understood that one skilled in the art will be able to make different variant embodiments of the invention, for example by combining the different characteristics described above taken alone or in combination, without going outside the framework of the invention.

The invention claimed is:

1. A sound diffusion device comprising a high-frequency section including at least one high-frequency acoustic source ($S_{HF}$) and a medium-frequency section comprising at least two medium-frequency acoustic sources ($S_{MF}$), the acoustic sources ($S_{HF}$, $S_{MF}$) being superposed vertically;

wherein the medium-frequency section comprises a lower subsection located below the high-frequency section and comprising at least one medium-frequency acoustic source $S_{MF}$ and an upper subsection located above the high-frequency section and comprising at least one medium-frequency acoustic source $S_{MF}$, and in that the vertical directivity of the high-frequency section has an inclination ($\mathbf{6}_{HF}$) from the horizontal (H) approximately equal to the inclination ($\mathbf{6}_{MF}$) of the vertical directivity of the medium-frequency section from the horizontal (H), such that the global vertical directivity of the device has a non-zero inclination (6$Di_r$) from the horizontal (H);

the high-frequency section also has a dissymmetric vertical wavefront; and the acoustic center ($C_{11f}$) of the lower subsection is set back from the acoustic center (Csup) of the upper subsection by a distance (R) such that an axis connecting the acoustic center ($C_{11f}$) of the lower subsection to the acoustic center (Csup) of the upper subsection, has a misalignment angle ($\mathbf{6}_D$) from the vertical (V) significantly equal to the inclination ($\mathbf{6}_{HF}$).

2. A device according to claim 1, wherein the inclinations ($\mathbf{6}_{HF}$, $\mathbf{6}_{MF}$) from the horizontal (H) are negative.

3. A device according to claim 1, wherein the wavefront has a variable curvature.

4. A device according claim 1, wherein the vertical wavefront is conformed using a vertical waveguide integrating at least one high-frequency acoustic source ($S_{HF}$).

5. A device according to claim 1, wherein the vertical wavefront is at least partially electronically conformed by processing of the sound signals sent to each of the high-frequency acoustic sources ($S_{HF}$).

6. A device according to claim 1, wherein at least part (Rb) of the setback (R) is electronically simulated by delaying the sound signals sent to each of the medium-frequency acoustic sources ($S_{MF}$) of the lower subsection and/or the upper subsection, by a delay equal to the time taken by sound to travel along the part (Rb) of the setback (R).

7. A device according to claim 1, wherein the medium-frequency acoustic sources ($S_{MF}$) of the lower subsection are aligned with each other along a first vertical axis and/or the medium-frequency acoustic sources ($S_{MF}$) of the upper subsection are aligned with each other along a second vertical axis.

8. A device according to claim 1, wherein the high-frequency section comprises a first number (n) of high-frequency acoustic sources ($S_{HF}$).

9. A device according to claim 8, wherein at least one high-frequency acoustic source ($S_{HF}$) is a compression motor.

10. A device according to claim 1, wherein the lower comprises a second number (m) of medium-frequency acoustic sources ($S_{MF}$) and the upper subsection comprises a third number (p) of medium-frequency acoustic sources ($S_{MF}$), the medium-frequency acoustic sources ($S_{MF}$) being identical and the absolute value of the difference between the second number (m) and the third number (p) is less than or equal to 2 and the second number (m) is more than the third number (p), also the second number (m) is equal to 4 and/or the third number (p) is equal to 2, or said difference is zero.

11. A device according to claim 1, integrated in a single "column" type of enclosure.

12. A sound diffusion system, comprising a first sound diffusion device according to claim 1, and a second sound diffusion device comprising a low frequency section or a very low frequency section.

13. A system according to claim 12, also comprising a mechanical interface between the first device and the second device capable of allowing one of the devices, to support the other device, and/or an electric interface between the first device and the second device that can enable one of the devices, to transmit sound signals and/or an electrical power supply to the other device.

14. A device according to claim 3, the variable curvature increasing downwards.

15. A device according to claim 14, the variable curvature being continuously variable so as to form a "J".

16. A device according to claim 8, the first number (n) of high-frequency acoustic sources ($S_{HF}$) being identical.

17. A device according to claim 8, the first number (n) being equal to 3.

18. A sound diffusion system, comprising a first sound diffusion device according to claim 1, and a second diffusion device comprising a low frequency section and a very low frequency section.

* * * * *